US011380977B2

(12) United States Patent
Chang et al.

(10) Patent No.: US 11,380,977 B2
(45) Date of Patent: Jul. 5, 2022

(54) MOBILE DEVICE

(71) Applicant: Acer Incorporated, New Taipei (TW)

(72) Inventors: Kun-Sheng Chang, New Taipei (TW); Ching-Chi Lin, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 17/216,892

(22) Filed: Mar. 30, 2021

(65) Prior Publication Data

US 2022/0085483 A1 Mar. 17, 2022

(30) Foreign Application Priority Data

Sep. 11, 2020 (TW) ..... 109131252

(51) Int. Cl.
*H01Q 1/22* (2006.01)
*H01Q 5/307* (2015.01)

(52) U.S. Cl.
CPC ..... *H01Q 1/2266* (2013.01); *H01Q 5/307* (2015.01)

(58) Field of Classification Search
CPC ..... H01Q 1/01; H01Q 1/05
See application file for complete search history.

(56) References Cited

U.S. PATENT DOCUMENTS 10,804,593 B2 10/2020 Chang et al.
10,886,633 B2 1/2021 Dorsey
2016/0156101 A1* 6/2016 Tsai ..... H01Q 5/328 343/745
2018/0048076 A1* 2/2018 Wei ..... H01Q 9/42
2020/0076061 A1* 3/2020 Chen ..... H01Q 21/0068
2020/0259271 A1* 8/2020 Lin ..... H01Q 3/34
2020/0313308 A1* 10/2020 Chang ..... H01Q 9/42
(Continued)

FOREIGN PATENT DOCUMENTS

TW M532668 U 11/2016
TW M551355 U 11/2017
TW I678842 B 12/2019

OTHER PUBLICATIONS

Chinese language office action dated Feb. 17, 2021, issued in application No. TW 109131252.

*Primary Examiner* — Lam T Mai
(74) *Attorney, Agent, or Firm* — McClure, Qualey & Rodack, LLP

(57) ABSTRACT

A mobile device includes a first radiation element, a second radiation element, a third radiation element, a fourth radiation element, a fifth radiation element, and a dielectric substrate. The first radiation element and the third radiation element are coupled to a signal source. The second radiation element is coupled to a ground voltage. The second radiation element is adjacent to the first radiation element. The first radiation element, the second radiation element, and the third radiation element substantially extend in the same direction. The fourth radiation element is coupled to the ground voltage. The fourth radiation element is between the first radiation element and the second radiation element. The fifth radiation element is coupled to the ground voltage. An antenna structure is formed by the first radiation element, the second radiation element, the third radiation element, the fourth radiation element, the fifth radiation element, and the dielectric substrate.

15 Claims, 5 Drawing Sheets

(56) References Cited

U.S. PATENT DOCUMENTS

| | | | | |
|---|---|---|---|---|
| 2021/0044000 | A1* | 2/2021 | Chang | H01Q 1/38 |
| 2021/0167521 | A1* | 6/2021 | Tsai | H01Q 1/243 |
| 2021/0366422 | A1* | 11/2021 | Kawashima | H01L 51/50 |

* cited by examiner

MOBILE DEVICE

CROSS REFERENCE TO RELATED APPLICATIONS

This application claims priority of Taiwan Patent Application No. 109131252 filed on Sep. 11, 2020, the entirety of which is incorporated by reference herein.

BACKGROUND OF THE INVENTION

Field of the Invention

The disclosure generally relates to a mobile device, and more particularly, it relates to a mobile device and an antenna structure therein.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. However, antennas tend to be affected by nearby metal elements, causing interference that can impact the quality of the wireless communication. Accordingly, there is a need to propose a novel solution for solving the problems of the prior art.

BRIEF SUMMARY OF THE INVENTION

In an exemplary embodiment, the disclosure is directed to a mobile device that includes a first radiation element, a second radiation element, a third radiation element, a fourth radiation element, a fifth radiation element, and a dielectric substrate. The first radiation element is coupled to a signal source. The second radiation element is coupled to a ground voltage. The second radiation element is adjacent to the first radiation element. The third radiation element is coupled to the signal source. The first radiation element, the second radiation element, and the third radiation element substantially extend in the same direction. The fourth radiation element is coupled to the ground voltage. The fourth radiation element is disposed between the first radiation element and the second radiation element. The fifth radiation element is coupled to the ground voltage. The fifth radiation element is adjacent to the second radiation element. The first radiation element, the second radiation element, the third radiation element, the fourth radiation element, and the fifth radiation element are disposed on the dielectric substrate. An antenna structure is formed by the first radiation element, the second radiation element, the third radiation element, the fourth radiation element, the fifth radiation element, and the dielectric substrate.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail below.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
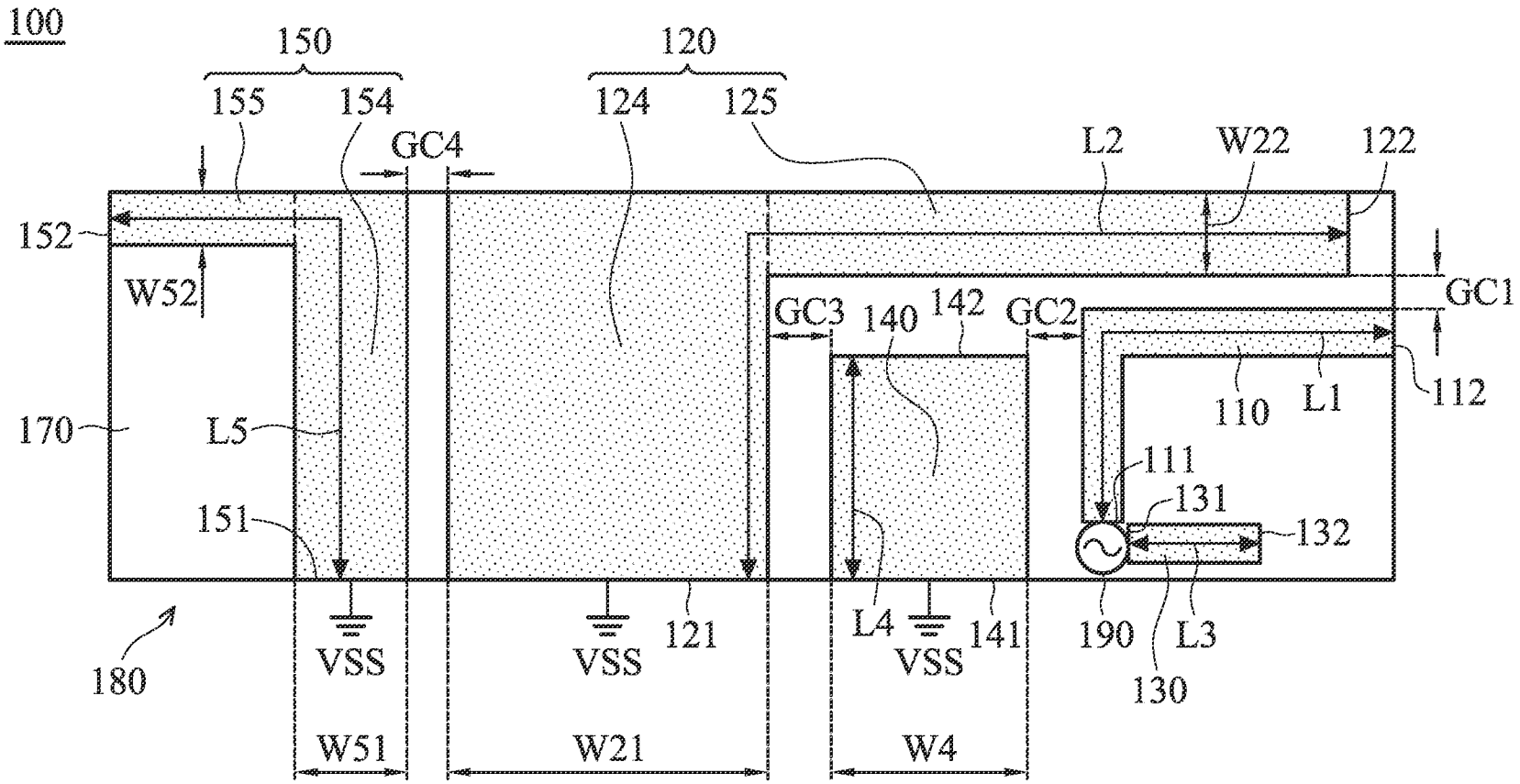
FIG. 1 is a view of a mobile device according to an embodiment of the invention.

FIG. 1 is a view of a mobile device 100 according to an embodiment of the invention. The mobile device 100 may be a smartphone, a tablet computer, or a notebook computer. As shown in FIG. 1, the mobile device 100 includes a first radiation element 110, a second radiation element 120, a third radiation element 130, a fourth radiation element 140, a fifth radiation element 150, and a dielectric substrate 170. The first radiation element 110, the second radiation element 120, the third radiation element 130, the fourth radiation element 140, and the fifth radiation element 150 may all be made of metal materials, such as copper, silver, aluminum, iron, or an alloy thereof. It should be understood that the mobile device 100 may further include other components, such as a processor, a touch control panel, a speaker, a battery module, and a housing, although they are not displayed in FIG. 1.

A ground voltage VSS of the mobile device 100 may be provided by a ground element (not shown). For example, the aforementioned ground element may be implemented with a ground copper foil, which may be further coupled to a system ground plane (not shown) of the mobile device 100.

The first radiation element 110 may substantially has an equal-width L-shape. Specifically, the first radiation element 110 has a first end 111 and a second end 112. The first end 111 of the first radiation element 110 is coupled to a signal source 190. The second end 112 of the first radiation element 110 is an open end. For example, the signal source 190 may be an RF (Radio Frequency) module.

The second radiation element 120 may substantially has a variable-width L-shape. Specifically, the second radiation element 120 has a first end 121 and a second end 122. The first end 121 of the second radiation element 120 is coupled to the ground voltage VSS. The second end 122 of the second radiation element 120 is an open end. The second end 122 of the second radiation element 120 and the second end 112 of the first radiation element 110 may substantially extend in the same direction. In some embodiments, the second radiation element 120 includes a wide portion 124 and a narrow portion 125. The wide portion 124 is adjacent to the first end 121 of the second radiation element 120. The narrow portion 125 is adjacent to the second end 122 of the second radiation element 120. It should be noted that the term "adjacent" or "close" over the disclosure means that the distance (the space) between two corresponding elements is smaller than a predetermined distance (e.g., 5 mm or shorter), or means that the two corresponding elements are touching each other directly (i.e., the aforementioned distance or space therebetween is reduced to 0). That is, the wide portion 124 of the second radiation element 120 is coupled to the ground voltage VSS. The second radiation element 120 is adjacent to the first radiation element 110, such that a first coupling gap GC1 is formed between the narrow portion 125 of the second radiation element 120 and the first radiation element 110.

The third radiation element 130 may substantially have a straight-line shape, which may be at least partially parallel to the first radiation element 110. Specifically, the third radiation element 130 has a first end 131 and a second end 132. The first end 131 of the third radiation element 130 is coupled to the signal source 190. The second end 132 of the third radiation element 130 is an open end. The second end 132 of the third radiation element 130 and the second end 112 of the first radiation element 110 may substantially extend in the same direction.

The fourth radiation element 140 may substantially have a rectangular shape, and it may be disposed between the first radiation element 110 and the second radiation element 120. Specifically, the fourth radiation element 140 has a first end 141 and a second end 142. The first end 141 of the fourth radiation element 140 is coupled to the ground voltage VSS. The second end 142 of the fourth radiation element 140 is an open end, which extends toward the narrow portion 125 of the second radiation element 120. A second coupling gap GC2 may be formed between the fourth radiation element 140 and the first radiation element 110. A third coupling gap GC3 may be formed between the fourth radiation element 140 and the narrow portion 124 of the second radiation element 120.

The fifth radiation element 150 may substantially have an equal-width or variable-width L-shape. Specifically, the fifth radiation element 150 has a first end 151 and a second end 152. The first end 151 of the fifth radiation element 150 is coupled to the ground voltage VSS. The second end 152 of the fifth radiation element 150 is an open end. The second end 152 of the fifth radiation element 150 and the second end 122 of the second radiation element 120 may substantially extend in opposite directions and away from each other. In some embodiments, the fifth radiation element 150 includes a first portion 154 and a second portion 155. The first portion 154 is adjacent to the first end 151 of the fifth radiation element 150. The second portion 155 is adjacent to the second end 152 of the fifth radiation element 150. The fifth radiation element 150 is adjacent to the second radiation element 120, such that a fourth coupling gap GC4 may be formed between the first portion 154 of the fifth radiation element 150 and the wide portion 124 of the second radiation element 120.

The dielectric substrate 170 may be an FR4 (Flame Retardant 4) substrate, a PCB (Printed Circuit Board), or an FCB (Flexible Circuit Board). The first radiation element 110, the second radiation element 120, the third radiation element 130, the fourth radiation element 140, and the fifth radiation element 150 may all be disposed on the same surface of the dielectric substrate 170. In a preferred embodiment, a planar antenna structure 180 is formed by the first radiation element 110, the second radiation element 120, the third radiation element 130, the fourth radiation element 140, the fifth radiation element 150, and the dielectric substrate 170.

Figure 2:
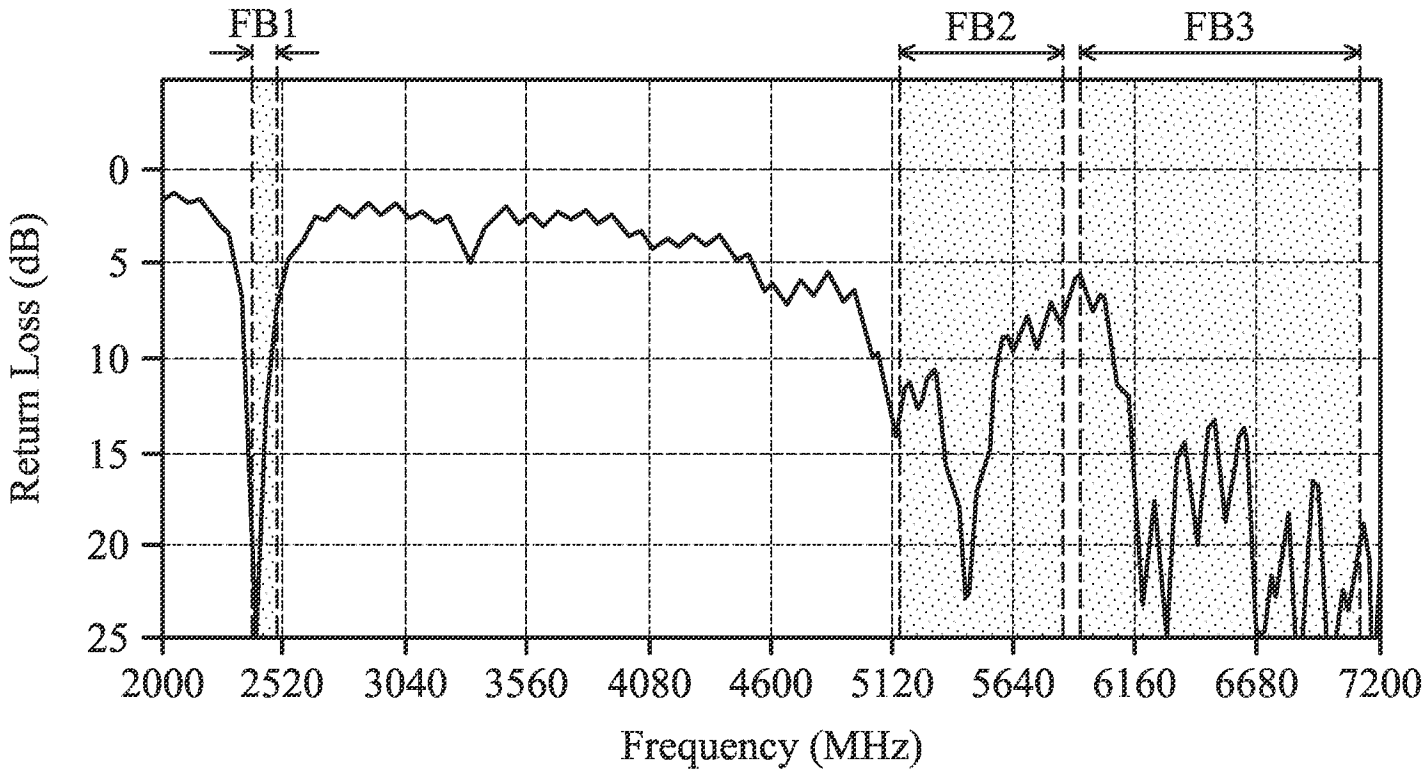
FIG. 2 is a diagram of return loss of an antenna structure of a mobile device according to an embodiment of the invention.

FIG. 2 is a diagram of return loss of the antenna structure 180 of the mobile device 100 according to an embodiment of the invention. The horizontal axis represents the operation frequency (MHz), and the vertical axis represents the return loss (dB). According to the measurement of FIG. 2, when being excited by the signal source 190, the antenna structure 180 of the mobile device 100 can cover a first frequency band FB1, a second frequency band FB2, and a third frequency band FB3. The first frequency band FB1 may be from 2400 MHz to 2500 MHz. The second frequency band FB2 may be from 5150 MHz to 5850 MHz. The third frequency band FB3 may be from 5925 MHz to 7125 MHz. Therefore, the antenna structure 180 of the mobile device 100 can support at least the wideband operations of conventional WLAN (Wireless Local Area Network) 2.4 GHz/5 GHz and the next-generation Wi-Fi 6e.

With respect to the antenna theory, the first radiation element 110 is excited to generate the second frequency band FB2. The second radiation element 120 is excited by the first radiation element 110 using a coupling mechanism, so as to generate the first frequency band FB1. The third radiation element 130 is excited to generate the third frequency band FB3. The fourth radiation element 140 is configured to fine-tune the impedance matching of the second frequency band FB2 and the third frequency band FB3. The fifth radiation element 150 is configured to fine-tune the impedance matching of the first frequency band FB1.

Figure 3:
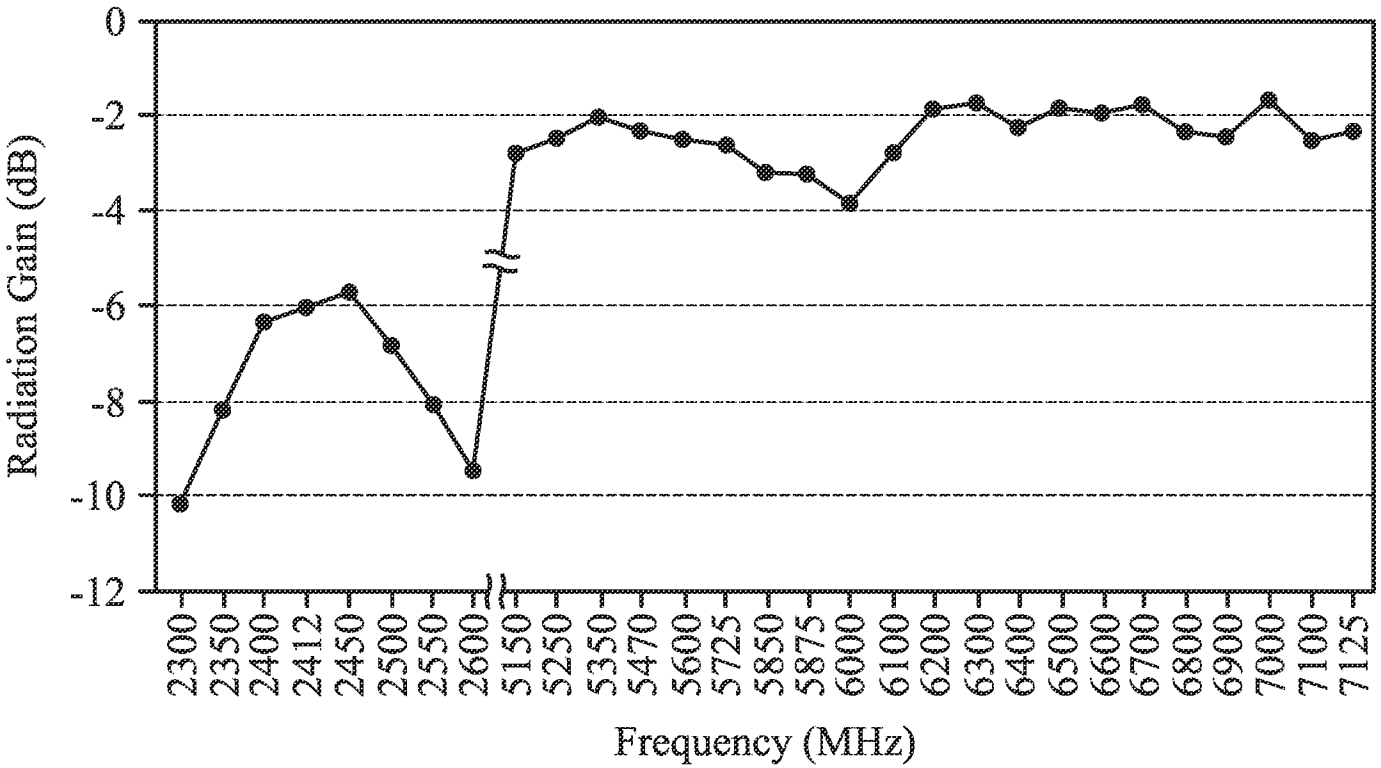
FIG. 3 is a diagram of radiation gain of an antenna structure of a mobile device according to an embodiment of the invention.

FIG. 3 is a diagram of radiation gain of the antenna structure 180 of the mobile device 100 according to an embodiment of the invention. The horizontal axis represents the operation frequency (MHz), and the vertical axis represents the radiation gain (dB). According to the measurement of FIG. 3, the radiation gain of the antenna structure 180 of the mobile device 100 can reach at least about −6 dB or higher within the first frequency band FB1, the second frequency band FB2, and the third frequency band FB3. It can meet the requirements of practical application of the next-generation Wi-Fi communication system.

In some embodiments, the element sizes of the mobile device 100 are described as follows. The length L1 of the first radiation element 110 may be substantially equal to 0.25 wavelength ($\lambda/4$) of the second frequency band FB2 of the antenna structure 180 of the mobile device 100. The length L2 of the second radiation element 120 may be substantially equal to 0.25 wavelength ($\lambda/4$) of the first frequency band FB1 of the antenna structure 180 of the mobile device 100. In the second radiation element 120, the width W21 of the wide portion 124 may be greater than or equal to 8 mm, and the width W22 of the narrow portion 125 may be from 2 mm to 3 mm. The length L3 of the third radiation element 130 may be substantially equal to 0.25 wavelength (λ/4) of the third frequency band FB3 of the antenna structure 180 of the mobile device 100. The length L4 of the fourth radiation element 140 may be from 4 mm to 5 mm. The width W4 of the fourth radiation element 140 may be from 2 mm to 3 mm. The length L5 of the fifth radiation element 150 may be longer than or equal to 10 mm. In the fifth radiation element 150, the width W51 of the first portion 154 may be from 2 mm to 4 mm, and the width W52 of the second portion 155 may be from 1 mm to 3 mm. The width of the first coupling gap GC1 may be smaller than or equal to 1 mm. The width of the second coupling gap GC2 may be smaller than or equal to 1 mm. The width of the third coupling gap GC3 may be smaller than or equal to 1 mm. The width of the fourth coupling gap GC4 may be smaller than or equal to 1 mm. The above ranges of element sizes are calculated and obtained according to many experiment results, and they help to optimize the operation bandwidth and impedance matching of the antenna structure 180 of the mobile device 100.

Figure 4:
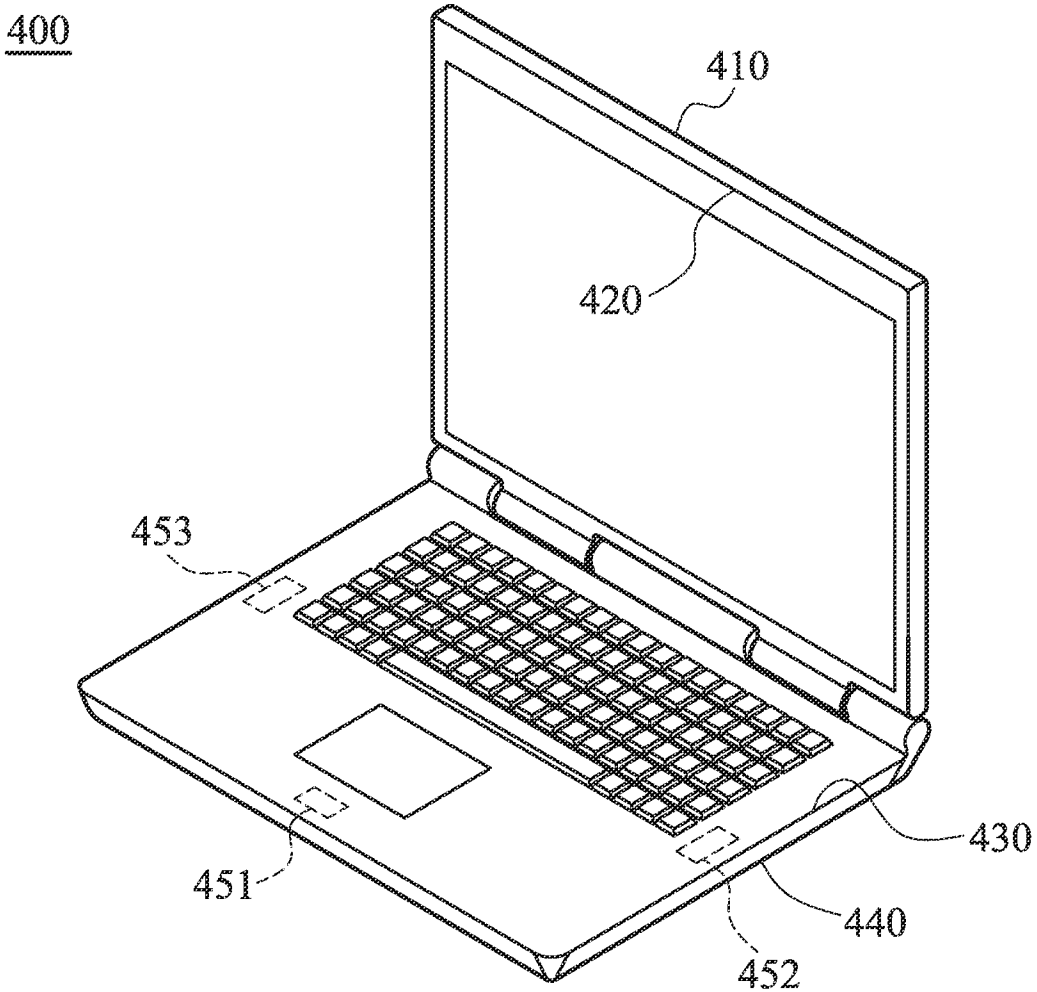
FIG. 4 is a view of a notebook computer according to an embodiment of the invention.

FIG. 4 is a view of a notebook computer 400 according to an embodiment of the invention. In the embodiment of FIG. 4, the aforementioned antenna structure 180 is applied to the notebook computer 400 which includes an upper cover housing 410, a display frame 420, a keyboard frame 430, and a base housing 440. It should be understood that the upper cover housing 410, the display frame 420, the keyboard frame 430, and the base housing 440 are equivalent to the so-called "A-component", "B-component", "C-component", and "D-component" in the field of notebook computers, respectively. The antenna structure 180 may be disposed at a first position 451, a second position 452 and/or a third position 453 of the notebook computer 400. The antenna structure 180 may be covered by the nonconductive keyboard frame 430. The keyboard frame 430 can be considered as an antenna window of the notebook computer 400. The electromagnetic waves of the antenna structure 180 can be transmitted through the keyboard frame 430.

Figure 5:
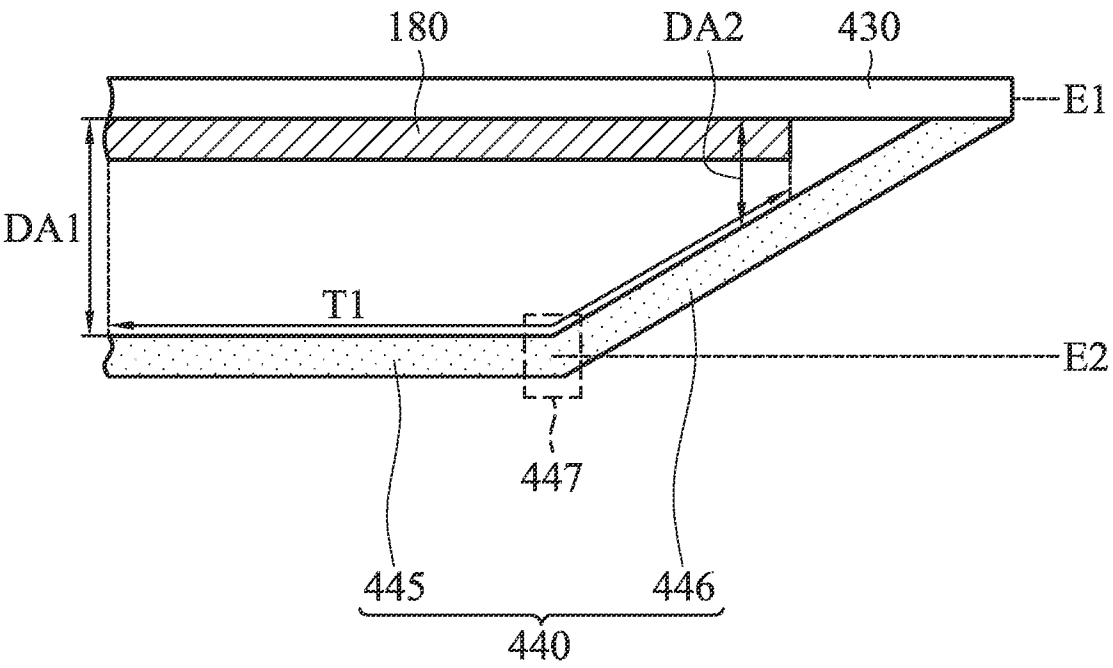
FIG. 5 is a partial sectional view of a notebook computer according to an embodiment of the invention.

FIG. 5 is a partial sectional view of the notebook computer 400 according to an embodiment of the invention. In the embodiment of FIG. 5, the base housing 440 includes a parallel region 445 and a cutting retraction region 446. The parallel region 445 may be substantially parallel to the keyboard frame 430. One side of the cutting retraction region 446 may be coupled to the parallel region 445, and the other side of the cutting retraction region 446 may be coupled to an edge of the keyboard frame 430. Specifically, the base housing 440 has a structural bending portion 447, which is positioned between the parallel region 445 and the cutting retraction region 446 and. Thus, the extension plane of the parallel region 445 is different from that of the cutting retraction region 446. There is a first average distance DA1 between the keyboard frame 430 and the parallel region 445. There is a second average distance DA2 between the keyboard frame 430 and the cutting retraction region 446. The second average distance DA2 is shorter than the first average distance DA1. For example, the second average distance DA2 may be substantially a half of the first average distance DA1. In some embodiments, the keyboard frame 430 is positioned on a first plane E1, and the parallel region 445 of the base housing 440 is positioned on a second plane E2 which is parallel to the first plane E1.

It should be noted that the antenna structure 180 is disposed between the keyboard frame 430 and the base housing 440. The antenna structure 180 has a vertical projection T1 on the base housing 440, and the vertical projection T1 is at least partially inside the cutting retraction region 446 of the base housing 440. According to practical measurements, if the width W21 of the wide portion 124 of the second radiation element 120 is 8 mm or longer, the radiation efficiency of the antenna structure 180 will not be affected by the close design of the cutting retraction region 446 of the base housing 440. Therefore, the antenna structure 180 of the invention can maintain good communication quality even if the whole base housing 440 is made of a metal material.

The invention proposes a mobile device and a novel antenna structure therein. In comparison to the conventional design, the invention has at least the advantages of small size, wide bandwidth, and beautiful device appearance, and therefore it is suitable for application in a variety of mobile communication devices.

Note that the above element sizes, element shapes, and frequency ranges are not limitations of the invention. An antenna designer can fine-tune these settings or values according to different requirements. It should be understood that the mobile device and antenna structure of the invention are not limited to the configurations of FIGS. 1-5. The invention may merely include any one or more features of any one or more embodiments of FIGS. 1-5. In other words, not all of the features displayed in the figures should be implemented in the mobile device and antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A mobile device, comprising:

a first radiation element, coupled to a signal source;

a second radiation element, coupled to a ground voltage, wherein the second radiation element is adjacent to the first radiation element;

a third radiation element, coupled to the signal source, wherein the first radiation element, the second radiation element, and the third radiation element substantially extend in a same direction;

a fourth radiation element, coupled to the ground voltage, wherein the fourth radiation element is disposed between the first radiation element and the second radiation element;

a fifth radiation element, coupled to the ground voltage, wherein the fifth radiation element is adjacent to the second radiation element; and a dielectric substrate, wherein the first radiation element, the second radiation element, the third radiation element, the fourth radiation element, and the fifth radiation element are disposed on the dielectric substrate;

wherein an antenna structure is formed by the first radiation element, the second radiation element, the third radiation element, the fourth radiation element, the fifth radiation element, and the dielectric substrate.

2. The mobile device as claimed in claim 1, wherein the first radiation element substantially has an equal-width L-shape.

3. The mobile device as claimed in claim 1, wherein the second radiation element substantially has a variable-width L-shape.

4. The mobile device as claimed in claim 1, wherein the second radiation element comprises a wide portion and a narrow portion, the wide portion is coupled to the ground voltage, and a first coupling gap is formed between the narrow portion and the first radiation element.

5. The mobile device as claimed in claim 4, wherein a width of the wide portion of the second radiation element is greater than or equal to 8 mm.

6. The mobile device as claimed in claim 1, wherein the third radiation element substantially has a straight-line shape, and is at least partially parallel to the first radiation element.

7. The mobile device as claimed in claim 1, wherein the fourth radiation element substantially has a rectangular shape, a second coupling gap is formed between the fourth radiation element and the first radiation element, and a third coupling gap is formed between the fourth radiation element and the second radiation element.

8. The mobile device as claimed in claim 1, wherein the fifth radiation element substantially has an L-shape, and a fourth coupling gap is formed between the fifth radiation element and the second radiation element.

9. The mobile device as claimed in claim 1, wherein the antenna structure covers a first frequency band, a second frequency band, and a third frequency band, the first frequency band is from 2400 MHz to 2500 MHz, the second frequency band is from 5150 MHz to 5850 MHz, and the third frequency band is from 5925 MHz to 7125 MHz.

10. The mobile device as claimed in claim 9, wherein a length of the first radiation element is substantially equal to 0.25 wavelength of the second frequency band.

11. The mobile device as claimed in claim 9, wherein a length of the second radiation element is substantially equal to 0.25 wavelength of the frequency band.

12. The mobile device as claimed in claim 9, wherein a length of the third radiation element is substantially equal to 0.25 wavelength of the third frequency band.

13. The mobile device as claimed in claim 1, further comprising:

a keyboard frame; and a base housing, comprising a parallel region and a cutting retraction region.

14. The mobile device as claimed in claim 13, wherein the antenna structure is disposed between the keyboard frame and the base housing.

15. The mobile device as claimed in claim 13, wherein the antenna structure has a vertical projection on the base housing, and the vertical projection is at least partially inside the cutting retraction region.

* * * * *